US005782045A

United States Patent [19]

Paschal

[11] Patent Number: 5,782,045

[45] Date of Patent: Jul. 21, 1998

[54] DENTAL TREATMENT UNIT

[75] Inventor: Richard Craig Paschal, Nashville, Tenn.

[73] Assignee: Haynes, Houk, Lewellen, Orr and Paschal, Associates

[21] Appl. No.: 387,338

[22] Filed: Feb. 13, 1995

[51] Int. Cl.[6] ..... E04C 2/52

[52] U.S. Cl. ..... 52/220.8; 52/27; 52/220.7; 312/209

[58] Field of Search ..... 52/27, 220.1, 220.8, 52/220.7; 312/209; 433/77

[56] References Cited

U.S. PATENT DOCUMENTS

| | | | |
|---|---|---|---|
| 2,344,149 | 3/1944 | Jory . | |
| 3,250,583 | 5/1966 | Phillips | 312/209 X |
| 3,455,620 | 7/1969 | Coburn | 312/209 X |
| 3,497,955 | 3/1970 | Gallagher | 32/22 |
| 3,524,256 | 8/1970 | Barker | 312/209 X |
| 3,623,283 | 11/1971 | Abromavage et al. | 128/2 R |
| 3,623,284 | 11/1971 | Meyer . | |
| 3,696,805 | 10/1972 | Sweeten et al. | 52/65 |
| 3,757,420 | 9/1973 | Silverman | 32/22 |
| 3,911,900 | 10/1975 | Shoen et al. | 52/29 X |
| 3,922,788 | 12/1975 | Rota | 32/22 |
| 4,095,379 | 6/1978 | Weintraub . | |
| 4,138,815 | 2/1979 | Williams | 32/22 |
| 4,160,323 | 7/1979 | Tracy | 32/22 |
| 4,177,612 | 12/1979 | Tochihara . | |
| 4,182,036 | 1/1980 | Tada et al. | 433/2 |
| 4,209,908 | 7/1980 | Fleer | 433/78 |
| 4,359,843 | 11/1982 | Schachar . | |
| 4,723,380 | 2/1988 | Mann et al. . | |

*Primary Examiner*—Carl D. Friedman
*Assistant Examiner*—Beth A. Aubray

[57] ABSTRACT

A dental treatment unit and method for use by dentists and the like, the treatment unit including an isolated aseptic central core component with a positive pressure internal environment, and which contains a work area for a dental dispensing assistant, plumbing, dental mechanical and electrical components, dental equipment and controls, dental instruments, and dental supplies. The supply core component mechanically engages, conveniently accesses, and provides function to an attachable treatment module enabling a dental team to provide treatment to a patient who is physically separated from all dental materials and medicament containers, cabinet and drawer handles, instruments, and dental devices, thereby creating an aseptic environment heretofore nonexistent in the dental profession. The treatment unit and method effectively eliminate all cross-contaminating common surfaces in the treatment module and provides a highly efficient functional design.

1 Claim, 7 Drawing Sheets

DENTAL TREATMENT UNIT

FIELD OF THE INVENTION

In a dental text book generally recognized as one of the outstanding treatise on endodontic therapy (root canal treatment) the author begins the chapter on sterilization techniques with the following statement: "The primary objective of sterilization and disinfection in the dental office is the prevention of disease transmission between patients and between patients and dental personnel. Transmission of infectious disease between individuals is termed cross-contamination. Sterilization and aseptic requirements in endodontic practice are not unlike disinfection for other areas of clinical practice. Patients are asked about their medical history at the initial appointment. Although this practice alerts a dentist to possible health problems, patients may unknowingly harbor a variety of infectious diseases, any one of which can be transmitted to other individuals, including the dentist and staff, if aseptic techniques are not carefully observed. The need for, and value of, microbiologic control with therapy was demonstrated in the late 1800's by Lister. The implications of cross-contamination, however, were not fully realized until the early 1900's. Over the years, injection of drugs and vaccines for such diseases as malaria, diabetes mellitus, and yellow fever led to an unusually high incidence of hepatitis. The consistent association of hepatitis with parenteral injection demonstrated the need for adequate microbiologic control. Bacterial disease could be controlled with relative ease, but control of viral hepatitis required strict observance of the basic principles of sterilization" (John I. Ingle, *Endodontics*, Lea and Febiger, 1976, p 589). In an equally notable oral surgery text book the author states, "The dental surgeon should prepare himself for surgical procedures in the treatment room in the same manner as the medical surgeon prepares himself for his work. Although it is impossible to sterilize the oral cavity, which incompasses the field of operation in most dental cases, the ritual of sterile technique is of great value in minimizing the possibility of introducing pathogenic organisms into the surgical wound. Thorough sterilization of instruments, drapes, gloves, sponges, sutures, and anything else that may come in contact with the field of operation directly or indirectly is essential" (W. Harry Archer, *Oral and Maxiliofacial Surgery*, W. B. Saunders Company, 1975, p 426). The authors of these dental text books call for aseptic procedures which parallel those practiced in the medical profession—established procedures which have been strictly followed in the medical profession since the turn of the century, exacting procedures which have evolved from the early antiseptic techniques developed by such pioneers as Lister to the highly developed aseptic procedures of the modern medical operating room, and technical procedures which are based on sound scientific facts derived from the science of microbiology. The public has a right to expect that they will receive dental treatment in the same aseptic environment as provided by the medical profession. In reality, even in dental offices equipped with the most up-to-date dental equipment and practicing the latest dental aseptic techniques, such an assumption would be invalid.

BACKGROUND OF THE INVENTION

The present invention addresses a profound discrepancy in medical and dental aseptic procedures in treatment rooms. Its primary focus is directed toward the unacceptable disregard for the basic principles of asepsis which occur routinely in the traditional dental treatment room resulting in pathogenic risks to dental patients and the long existing, but unmet need, for a dental unit and method which will provide an aseptic environment in dental treatment rooms. Thus the present invention addresses what will be shown to be unacceptable practices in traditional dental treatment rooms which expose patients to unnecessary cross-contamination certainty.

1. The Problem In The Traditional Dental Treatment Room

To assess the problem it is necessary to consider the definition of the term "invasive procedure" and determine if there is any significant difference in the need for asepsis in dental versus medical treatment procedures. Medical dictionaries generally define the term "invasive" as involving puncture or incision of the skin or insertion of an instrument or foreign material into the body. Beyond simple visual examinations most dental procedures would have to be considered as being invasive. Even in routine prophylaxis (cleaning) minor soft tissue injury and bleeding often occur. In placing relatively simple fillings it is frequently necessary to make subgingival preparations or place matrix bands which result in minor soft tissue injury and bleeding. Obviously, oral surgery, periodontal surgery, involved crown and bridge procedures, and endodontic therapy are all invasive. The problem relates to the fact that in the traditional dental treatment room there are many surfaces that cannot be sterilized and, therefore, become common surfaces—that is common patient to patient. Some examples are drawer handles, impression material tubes, cement tubes, varnish bottles, medication tubes and containers, dental unit and amalgamator electrical switches, bonding supply containers, topical anesthetic containers, retraction cord containers, x-ray film when stored in bulk or film dispenser handles, burs in bur blocks, amalgam capsules when stored in bulk containers, articulation paper books or plastic dispensers, glass ionomer kit containers, mixing pad edges, towel dispenser handles, wedge containers, topical hemostatic solution containers, post system containers, pin system containers—the list could go on. All of these items are frequently handled and contaminated during various treatment procedures and cannot be sterilized between patients. In addition to the above items and of equal consideration are the hoses which deliver water, air, electrical impluses, and curing light from the dental unit to the attaching dental instruments, i.e., air-water syringe, handpieces (drills), vacuum, cavitron, curing light, etc. All of these hoses are covered with contaminating aerosols and spatter during treatment procedures and also become cross-contaminating surfaces.

In recent years dental personnel have begun covering the handles on dental lights to avoid cross-contamination of patients from repeatedly touching the light handle with contaminated gloves when adjusting the position of the light. Obviously, if the light handle were not covered, it would become a cross-contaminating surface as it is touched many times during every treatment procedure and cannot be sterilized between patients. The ineffectiveness of wiping the light handle with alcohol or a disinfectant between each patient is apparent when one considers that in many cases blood would be present in the saliva and pathogens associated with blood require autoclaving. Disposable light handle covers or preferably detachable autoclavable light handles have effectively eliminated this problem. Unfortunately there are numerous surfaces around the patient that are identical to the light handle—common surfaces—but they cannot be covered or sterilized. The drawer handle a dental assistant touches is covered with microorganisms from previous patients. All containers the assistant touches are touched repeatedly with contaminated gloves and used patient to patient. The same problem applies to containers removed from what is the latest effort to confront this problem by dental equipment manufactures; namely "the tub." On the surface "the tub" appears to be a workable solution but when the concept is critically examined one finds a problem. In this concept containers are simply removed from drawers and cabinets and put into small supply tubs and brought into the room with each patient. It appears that with each patient a disposable or personalized set of supply containers have been assembled and will not go beyond a one-patient treatment procedure. The concept fails when one considers that the material containers are not incremental proportions designed to dispense as disposable items but are bulk quantity containers which obviously will not be disposed of after being used on one patient but at best wiped with alcohol or a disinfectant and placed into another tub for use on the next patient. Note in the preceding sentence "at best" was used—realistically in most offices even the wipe down is doubtful. Disposable material and medicament incremental packaged units would pose a new set of problems involving unit quantity, need specificity, increased cost, handling, and the temptation to reuse unused externally contaminated items.

How many patients are being cross-contaminated in the traditional dental treatment room? The answer is virtually 100% following the first patient each day when involved treatment procedures are carried out in the same room on a given day. If handles and containers are touched with the same gloves that touch a patient's mouth or items from the mouth, patients will be cross-contaminated. Is it possible to address the problem by using more gloves? Yes, it is possible but totally impractical in terms of time (glove removal, hand wash, regloving) and as much as a ten-fold increase in the consumption of gloves. Given the existing practices in the traditional dental treatment room one question becomes paramount, are patients being infected? If only one patient in a thousand is infected the situation becomes unacceptable. Based on our knowledge of microbiology the figure is probably far greater than one patient in a thousand. Today's pathogenic risks are far more serious than they were in even the recent past. With the resurgence of TB, the increasing HIV positive population, and simply considering the common cold and influenza, one can be certain that an educated public will find the existing situation unacceptable and threatening.

Only recently has the dental profession become concerned about these new pathogens in terms of studies to gauge the threat they pose to the dental team. The University of North Carolina at Chapel Hill has released a "pilot study" resulting from funding by a Siemens subsidiary. In this study the authors state, "The potential for transmission of disease to personnel during dental procedures has become a source of increased concern to members of the dental profession and the public. Previous studies have shown that microorganisms in the oral cavity and respiratory tract can be transported in the aerosols and spatter generated during dental procedures and can contaminate the skin and mucous membranes of the mouth, respiratory passages and eyes of dental personnel. These airborne contaminants exist in the form of spatter, mists and aerosols of blood-contaminated saliva. Spatter consists of droplets which are usually greater than 50 microns in diameter and can contain infectious bacteria and viruses harbored in blood, respiratory secretions and saliva. HIV and HBV have been transmitted to health care workers by blood spatter" (Bentley, Burkhart, and Crawford, *The Journal Of The American Dental Association*, May 1994, p 579). This study was not intended to address patient cross-contamination from aerosol and spatter, but it is obvious that this debris which the authors mention is not limited to the garments and exposed tissues of the dental team but also comes into contact with all surfaces in the treatment environment—surfaces that are routinely touched by gloves that come into direct or indirect contact with a patient's mouth.

To underscore the seriousness of the multiple-drug resistant tuberculosis strains the March 1994 American Dental Association news letter carried an article citing what was described as the "bad news" about the disease. The article states that "one out of seven TB cases—more than previously suspected—are drug resistant. In the study on multiple-drug resistant strains of TB, CDC researchers analyzed more than 3,000 TB cultures from 36 states. They discovered that 14.2% of the cultures were resistant to at least one antituberculosis drug." In another article in the same news letter the following statement is made, "The American Dental Association strongly believes that patients with active, infectious TB pose a direct threat to the health of dentists and their employees. That threat, unlike AIDS, cannot be satisfactorily minimized in the private dental office by using standard, universal precautions." Note that in the latter article the dental profession is being told to refer TB patients for treatment; yet, the dentist is being encouraged and in some states legally forced to treat active AIDS patients within the traditional dental treatment room. According to CDC research, the AIDS virus is an extremely weak life form which is easily destroyed by proper aseptic procedures and poses no threat to the dental team with barrier utilization. We must presume proper aseptic procedures will also protect the patient from cross-contamination risk. Keep in mind that with each passing year the frequency of treating patients at various stages of HIV infection will continue to increase, and even now no one can assume that he is not following an HIV positive patient when seated in the dental chair. One might assume that his dentist would not allow him or a member of his family to follow an HIV positive patient into a treatment room—another invalid assumption. His dentist will not be able to identify many of these patients. Why? Because these patients may not know that they are infected or may choose not to identify their conditions. The traditional dental treatment room is not a safe environment to eliminate the risk of cross-contaminating patients with an intestinal virus, not to mention the more threatening diseases mentioned above. The question could be raised as to whether it is even possible to establish aseptic treatment procedures in the traditional dental treatment room which would insure the safety of patients from cross-contamination with HIV, HBV, TB, and a variety of less serious pathogens. It is apparent that dental patients are vulnerable to cross-contamination under existing conditions in treatment rooms.

What sort of studies are called for to validate the case being made in this application against the traditional dental treatment room? No studies are needed. The case being made in this application was validated by researchers in the early 1900's and has since been proven as sound as any established law within the basic sciences. The way things are done in the traditional dental treatment room does not eliminate the risk of cross-contamination in light of what we know to be factual within the science of microbiology. Such practices are unacceptable when the health and safety of a human being is at risk. This matter is a scientific consideration with no room for speculation regarding the possibility of cross-contaminating dental patients with potentially lethal diseases.

An absolute fact is that a great need for asepsis has been unmet since the beginning of modern dentistry. The present invention directly addresses this long existing yet unmet need by providing the dental profession with a dental treatment unit and method which will enable a dental team to provide a patient with an aseptically safe treatment environment while creating a highly efficient design in terms of dental procedure productivity.

2. The Long Existing Need

What is needed is a dental treatment unit and method that will eliminate the following deficiencies which prevent aseptic procedures in the traditional dental treatment room: (1) drawers and cabinets in the treatment environment and the handles associated with same, (2) common cross-contaminating containers, (3) common cross-contaminating surfaces, (4) common cross-contaminating equipment (unless autoclavable), and (5) any potential for cross-contamination of dental patients including all surfaces exposed to contaminating spatter, aerosols, and touch. At present the state-of-the-art traditional dental equipment would fail to eliminate any of the above deficiencies.

In 1974 a book was published entitled *Four-Handed Dentistry*. The term, "four-handed dentistry" has since been used within the dental profession to describe the proper chair side utilization of dental auxiliaries by the dentist. The concepts involved in four-handed dentistry relate to the coordinated hand movements between the dentist and the dental assistant in achieving a maximum level of efficiency during treatment procedures. Considering the existing problem and the above deficiencies in the traditional dental treatment room it becomes apparent that an additional employee is needed in order to provide aseptic dental treatment. In the four handed concept all four hands are directly involved in the contaminated work field thus contaminating any surface they touch. What is needed is another team member physically isolated from contamination, a dental treatment unit which can provide this isolation yet maintain convenient access to a treatment room, and a method which will maintain asepsis while providing a high degree of efficiency. The described need has existed throughout the history of dentistry, the need has never been effectively addressed, and the need is immediate.

SUMMARY OF THE INVENTION

While the present invention can be employed as a core combined with a single treatment module, it can also be expanded to provide a dental treatment unit wherein a plurality of individual treatment modules surround and connect to one central supply core. As in the single or one treatment module to one supply core arrangement, in the plurality arrangement the connection between the supply core and surrounding treatment modules is established through a plurality of receptor sites disposed about the external perimeter of the supply core. Treatment module receptor sites are evenly spaced around the core's periphery, and each site is provided with an operative glass window for the passage of items from within the core into the modules and for the observation of unattended patients awaiting treatment within treatment modules. Within the supply core, dental equipment and associated controls as well as all instruments and dental supplies are contained and are physically isolated from the contaminants generated during dental procedures carried out within the surrounding treatment modules. A rotating multilevel instrument and supply storage apparatus is disposed centrally within the core which may be rotated to align storage slots with module aperatures for access thereto by a dental dispensing assistant to facilitate delivery of materials to dental team members working within treatment modules. The core component establishes an isolated space formed by walls, floor, and ceiling which can be accessed through a door equipped with an effective air seal when closed. The core space is pressurized with filtered uncontaminated air thereby creating a positive pressure environment and resulting in an outward flow of air through any opened aperture. The positive pressure and resulting outward air flow prevents contamination of the internal core space by the back flow of potentially contaminated external air from the treatment environment. The core component contains a work space for a dental dispensing assistant, dental units, plumbing, dental mechanical and electrical equipment, dental equipment controls, dental treatment instruments, dental supplies, and the necessary storage cabinets and drawers. Therefore, the present invention introduces a new term to the dental profession—"six-handed dentistry" (a registered trademark). Six-handed dentistry involves the addition of a dispensing assistant to the dental team thus enabling the dentist and traditional chair side dental assistant to function within treatment modules in the conventional manner (in the contaminated work field) while isolating this new team member from the contaminants of the treatment area. The dispensing assistant's primary responsibility is the dispensing of all dental materials, supplies, and instruments from the uncontaminated core environment through a plurality of apertures accessing the treatment modules which surround and engage the core component systems. It is important to note that while the treatment modules are disposed radially outwardly from the core they are not a fixed part of the core but are optionally attachable units which engage or plug into the core systems to enable their function.

The present invention provides the following advantages heretofore nonexistant in dental treatment rooms:

1. By physically isolating materials, instruments, and supplies from the contaminated treatment environment, these items may be handled without being contaminated. Surfaces within treatment modules including the dental chair, stools, and counter tops are to be covered with disposable plastic which is discarded and replaced between patients.
2. The core complex environment is protected from external airborne contaminants through the use of positive pressure filtered outside air within the core and the flow of said air through any opened aperture is sufficient to prevent the backflow of contaminated air from treatment modules. It should also be noted that adequate ventilation is established within treatment modules to eliminate aerosols emitted from the high speed handpiece from drifting to the other treatment modules during treatment procedures.
3. Central visual monitoring of patients seated in treatment modules is made possible by operable glass windows situated in the core walls above module connectors. The dispensing assistant can easily scan any module and observe a patient's condition. Patients are frequently given anesthetics and medications and left alone prior to treatment and, while uncommon, there are instances of anaphylactic reactions which must be treated immediately.
4. The present invention enables all dental equipment and associated adjustment controls (i.e. air and water pressure adjustment knobs) to be installed within the supply core. The dispensing assistant can make any adjustment requested by the dentist or chairside assistant without contaminating such controls. Currently all dental equipment and associated controls are within the contaminated treatment area.

5. When a module is attached to the core a connection is established between the dental equipment within the core and a terminating quick disconnect block within the treatment module. The major advantage derived from the quick disconnect design is that the tubing involved in connecting the dental equipment with traditional dental instruments (drills, vacuum, and air-water syringe) can be attached and removed following a treatment procedure for washing and cold sterilization between patients. At present conventional dental equipment involves tubing which is not detachable following treatment procedures and, therefore, is continually contaminated with spatter thus becoming a cross-contaminating means.
6. The present invention provides a means of accessing a plurality of treatment modules from a central supply core with minimal reach thus providing the desired isolated space while creating a highly efficient servicing structure and method in terms of dental procedure productivity.
7. The present invention provides a means of accessing a plurality of treatment modules from a central supply core, therefore, eliminating the necessity of duplicating many dental instruments. For example, one amalgamator located within the central core may be rotated to serve all treatment modules while one amalgamator is required in every traditional dental treatment room. Other examples of reduced duplication would include curing lights, bead sterilizers, and water baths.
8. The present invention provides a significant plumbing advantage in that all plumbing is built into the walls of the central core complex and above the floor. The entire dental treatment unit with all attached modules requires only one connection to water, sewer, and air. It should be noted that central systems (air compressor and vacuum pump) can be housed within the core or remotely located in the conventional manner. The primary advantage is that plumbing is above the floor, therefore, expanding the potential for virtually any office space to be used for a dental treatment facility as well as substantially reducing the amount of plumbing materials required.
9. The present invention provides total flexibility in the number of dental treatment rooms a dentist might desire when initially starting his practice. A dentist might purchase a core equipped with six treatment module receptor sites and purchase only two or three treatment modules adding additional modules as his practice expands. Obviously, total flexibility exists in the application of this concept including the one station core with the six-handed materials handling method applied to a core and treatment module fabricated as a single unit.
10. The present invention provides an option with regard to how the dispensing assistant will move within the core work space. In a small private dental practice the dispensing assistant could walk from one module access aperture to another utilizing traditional stools while in large dental practices and particularly in a military clinic setting, it would be advantageous to utilize an automated system which would transport the dispensing assistant to any module access aperture at the press of a button.

The present invention meets all of the needs cited above. It eliminates drawers, cabinets, and the associated handles within the treatment room, it eliminates common containers within treatment rooms, it eliminates common surfaces within treatment rooms, it eliminates common equipment (unless autoclavable) within treatment rooms, and it eliminates any potential for cross-contamination of dental patients including all surfaces exposed to contaminating spatter, aerosols, and touch. Everything required for treating a patient is dispensed from the central supply core complex and nothing is returned from the treatment module directly to the core. All materials used during a treatment procedure are either disposed of or are processed through a central sterilization room (optionally a specifically designed sterilization module which engages the core) and then back to the central supply core. It is significant that with the utilization of a sterilization module which engages the core the ultimate advantages of a pass-through autoclave are achievable.

U.S. Pat. Nos. 4,095,379, 4,359,843, and 4,723,380 are of interest in that they relate primarily to the medical field yet exhibit a total disregard for the primary objective of the present invention in that each patent not only fails to address asepsis but through design provide a means for cross contamination of patients.

U.S. Pat. No. 4,095,379 (Weintraub) discloses an ophthalmic servicing structure comprising a rotatable instrument table mounted central within the office. A plurality of patient examining stations are disposed radially outwardly from a central rotating table. The table is selectively positionable adjacent to any treatment room for equipment access by the physician from a treatment room. The equipment table includes four standard ophthalmic instruments permanently affixed to the table segments. These table segments are slidably mounted to the central table for movement between a storage position and a treatment position wherein the segment is projected into a treatment room. Considering a dental application the following conceptual deficiencies are cited when compared to the present invention:

1. The ophthalmic equipment serves as a cross-contamination vehicle as it travels from the central storage area into a treatment room then back to the central storage area for repositioning to access another room.
2. The central equipment housing area is also contaminated as the patent calls for the return of the equipment directly from the treatment room to the central storage area. It should be noted that sterilization of the described equipment would be nearly impossible even if suggested. Also in addition to equipment contamination it should be noted that the patent specifically requires that the rotatable table include "extensible means for extension between the patient and doctor station means in each said room and adapted for supporting instruments thereon" (column 8, lines 8–10). This language appears to describe a sliding table segment which is susceptable to debris accumulation and certain contamination.
3. There exists no design or intent to isolate the central equipment area environment from the treatment room environment; thus, contaminants would drift back into the central equipment area through the access openings.
4. The patent is ophthalmic function specific and is not conceptually applicable to a dental function. It appears that the intent of the patent relates strictly to ophthalmic examination procedures and not to any surgical application. It is assumed that any ophthalmic surgical procedures would be carried out in an operating room. In contrast the present invention is intended for a dental surgical application.

5. There exists no design or intent to involve a human function within the central equipment area. The mechanical design provides no space for this possibility.
6. By design the patent eliminates the possibility of servicing more than one treatment room at the same time. The patent discloses four ophthalmic instruments evenly spaced at 90 degree intervals around the table. The treatment rooms are spaced at 120 degree intervals radially outwardly from the table. Therefore, when one table segment is extended into a treatment room, access is denied to the remainder of the instruments.
7. By design the patent eliminates the possibility of visual monitoring of patients in treatment rooms. The significance of this advantage in the present invention should not be underestimated as patients are frequently left alone following administration of anesthetics and other drugs. Although rare the possibility of anaphylactic reaction must always be recognized as a potential threat.
8. By design the patent calls for a highly questionable arrangement with regard to production efficiency. As stated above the patent eliminates the possibility of servicing more than one treatment room at the same time and of significant importance it also limits the utilization to one physician.
9. The patent's specific objective is the reduction of equipment and in no way deals with patient protection from cross-contamination.

U.S. Pat. No. 4,359,843 (Schachar) discloses an office having a plurality of examining rooms in linear alignment. A movable cart is disposed adjacent the rooms for linear movement between any of the examining room stations. The cart is selectively positionable at an examining room for access to instruments contained on the cart. A central storage area is provided adjacent to the cart opposite from the examining rooms for loading and unloading thereof. The cart is selectively controllable for positioning at any examining room. Considering a dental application of this patent the following conceptual deficiencies are cited when compared with the present invention:

1. The equipment serves as a cross-contamination vehicle as it travels from one treatment room directly to another.
2. There exists no design or intent to isolate the environment above the track from the environment within each treatment room.
3. Again it appears that the intent of the patent relates strictly to examination procedures and not to any surgical application. It is assumed that any surgical procedures would be carried out in an operating room. In contrast the present invention is intended for a dental examination and surgical application.
4. Again by design the patent eliminates the possibility of servicing more that one treatment room at the same time.
5. By design the patent eliminates the possibility of visual monitoring of patients left alone in treatment rooms. As stated above the significance of this advantage in the present invention should not be underestimated.
6. By design the patent calls for what appears to be an inefficient arrangement. Here again it appears that more than one doctor and cart could not function at the same time.
7. The patent's specific objective is the reduction of equipment and in no way deals with patient protection from cross-contamination.

U.S. Pat. No. 4,723,149 (Mann et al.) discloses an ophthalmic examination unit which is pivotably mounted to a support. As best seen in FIG. 1, the examination unit 7 is disposed behind a sliding door 19 for pivotable movement into and out of a treatment room. Mann et al. discusses the applicability of this device with the rotatable ophthalmic table disclosed in the Weintraub patent and while this patent provides an improvement on the sliding table segments of Weintraub, it is of little concern with regard to the present invention.

None of the above patents disclose the central isolated equipment and supplies including the quick disconnect instruments in treatment rooms in combination with the central plumbing. Further, none of the above patents disclose the control of air pressure within an isolated core for the protection of said core and its contents from contaminating air drifting from treatment rooms. Of primary importance none of the above patents eliminate common contaminated surfaces but in reality create contaminating surfaces. In any event, none of the patents disclose the combination of concepts disclosed in the present invention for a dental application.

None of the other patents disclose apparatus sufficiently similar to the present invention to warrant comment. So far as the applicant is aware none of the above prior art has ever been marketed and is not currently available for purchase.

LIST OF REFERENCE NUMBERS 1. dentist
2. patient
3. dental assistant
4. mobile dental cart
5. dental supply and medicament container
6. dental instrument and medicament tray
7. dental unit support for instrument tray
8. dental unit
9. dental unit support arm for vacuum, air-water syringe, and handpieces
10. dental instruments (handpieces/drills, vacuum, water/air syringe)
11. drawer handle
12. glove-covered hand of dentist
13. dental chair
14. countertop
15. glove covered hand of dental assistant
16. represents amalgamator, curing light, bead sterilizer, etc.
17. work space for supply dispensing assistant to function
18. attachable module in pre-engage position
19. female connectors for dental unit to access core systems
20. sterilization module
21. rotatable central supply unit
22. countertop within supply core
23. countertop within treatment module
24. door into core
25. countertop within sterilization module
26. pass-through autoclave
27. open drawer within core
28. drawer handle within core
29. medicament container within drawer
30. dental instruments supported on quick disconnect block
31. pass through autoclave door on side of sterilization module
32. pass through autoclave door on side of core work space
33. conventional dental unit support arm 34. connector on module to engage core systems
35. plumbing connections between dental unit 50 and quick disconnect block 48
36. scrub sink
37. attachable quick disconnect block supporting dental instruments (handpieces, vacuum, water/air syringe) and equipped with cut off switches when instruments rest within housings
38. passage way into core space
39 dental cabinets
40. cabinet drawers
41. dental instrument hoses
42. aseptic central core component
43. passage way into sterilization module
44. sterilization module door
45. access opening in glass wall separating treatment module and supply core
46. quick disconnects for connecting item 37 and 48
47. connectors for water, sewer, vacuum, electrical
48. quick disconnect block support receiving item 37
49. patient's oral cavity
50. control head mechanism isolated within supply core
51. dental stool
52. treatment module wall
53. glass wall enabling visual monitoring of patients in treatment modules from central core
54. air filtration unit above ceiling of central core complex
55. glove covered-hand of dispensing assistant
56. arrow depicting positive air flow movement from core into treatment module
57. disposable transport tray
58. area of aseptic inviolate zone
59. central support column for rotating central supply unit 21
60. base of rotating central supply unit 21 secured to floor of central core
61. top rotating supply element of rotating central supply unit 21
62. recessed storage space within item 61
63. middle rotating supply element of rotating central supply unit 21
64. recessed storage space within item 63
65. rotating instrument housing of rotating central supply unit 21
66. recessed storage space within item 67
67. bottom rotating supply element of rotating central supply unit 21
68. amalgamator attached to item 65
69. additional instrument position on item 65
70. recessed storage space within item 67
71. connector for dental unit foot control
72. dental unit foot control
73. connector for dental unit foot control hose
74. arrow showing direction of materials flow
75. recessed storage space within item 61
76. recessed storage space within item 63
77. below counter space for central systems (air compressor, deaquator, and vacuum pump)
78. ring supports for handpieces and water/air syringe
79. ceiling of central core
80. path of electrical conduits and plumbing from item 77
81. sewer, water, and electrical access to municipal systems
82. space between rotating central supply elements to allow visual monitoring of patients
83. work positions within central core
84. ventilation duct to outside

BRIEF DESCRIPTION OF DRAWINGS

A better understanding of the invention can be attained by reference to the following Detailed Description in conjunction with the accompanying Drawings, wherein:

FIG. 2 also depicts the unique advantage of the central core being isolated from the treatment environment thus providing an uncontaminated area for the storage and dispensing of dental supplies, equipment, and instruments.

FIG. 3 is also a more detailed view of the coupling mechanisms which enable the treatment modules to engage the central core.

FIG. 5 also depicts a sterilization module as well as all dental chairs and stools in their typical positions within the surrounding treatment modules.

FIG. 6 illustrates the unique design of the present invention and the associated aseptic advantages of the separation of treatment rooms from the area where dental material containers and instrument are stored and handled.

FIG. 8 depicts a design wherein each level of the central storage unit may rotate independently of other levels thus enabling any combination of slots on each level to be aligned opposite any treatment module access window for the dispensing of dental materials, instruments, and supplies.

DETAILED DESCRIPTION OF THE INVENTION

Figure 1:
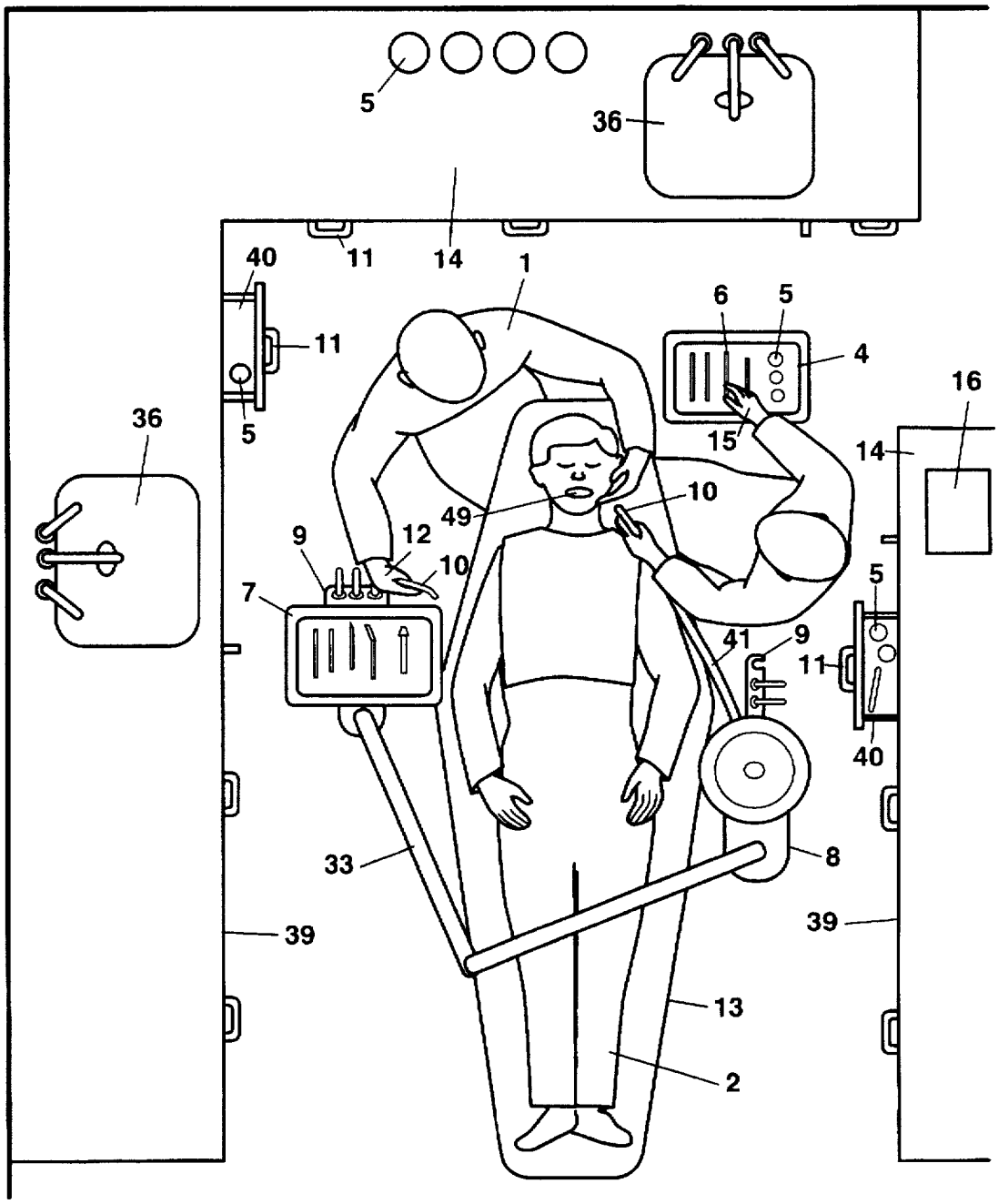
FIG. 1 is a plan view of a traditional dental treatment room depicting a dentist working on a patient and being assisted by a dental assistant. A dental unit is depicted along with surrounding dental cabinets, open and closed drawers, dental instruments, supplies, and containers associated with treatment procedures.

With reference to the drawings, it should be noted that reference numbers used to identify specific parts are common to each of the drawings and are identified in the list of reference numbers. The list of reference numbers contains some but does not necessarily identify all components required for functional dental units as the primary objective will be to identify those features which are unique to the present invention. FIG. 1 is included to further clarify the flaws associated with the typical conventional dental treatment room thus enabling the reader to more fully appreciate the benefits provided by the present invention. FIG. 1 shows a plan view of a traditional dental treatment room. Observe that dentist 1 is working on patient 2 while being assisted by dental assistant 3. Dental patient 2 is seated in dental chair 13 while dental unit 8 is utilized to provide function for dental instruments 10 housed in support racks 9. Note that the dentist's instrument tray 7 is supported by a mechanical arm 33 extending from dental unit 8 and that the dental assistant's instrument tray 6 is supported atop mobile cart 4 The dentist and dental assistant are surrounded by dental cabinets 39 housing drawers 40 with drawer handles 11, said drawers containing dental supply and medicament containers 5. Countertops 14 support additional dental supply and medicament containers 5, sink 36, and additional dental equipment such as amalgamator 16.

The long existing problem with the traditional dental treatment room is quite apparent in FIG. 1. Observe gloves 12 won by the dentist 1 and gloves 15 woe by the dental assistant 3 and envision the cross-contamination resulting from the movement of the hands between the wet saliva field in and around the patient's oral cavity 49 and the surrounding containers 5, drawer handles 11, and equipment 16. The same gloves that come into direct contact with the patient's saliva, which frequently contains blood, also come into direct contact with drawer handles 11, supply and medicament containers 5, dental amalgamator 16, countertops 14, and the top edges of instrument tray support apparatus 7 and 4. As previously stated, containers 5, drawer handles 11, dental instruments 16, and countertops 14 are frequently touched and contaminated during treatment procedures and cannot be sterilized between patients. In addition to these items, dental unit hoses 41 as well as all exposed surfaces within the treatment room are covered with contaminating aerosols and spatter generated by the high speed handpieces (drills) during treatment procedures and also become cross-contaminating surfaces. What can be observed in FIG. 1 is a production facility not unlike any other business when one considers the fact that dentists not only provide a specific form of health care to the population, but also run a business and must be concerned about production efficiency. Consider the impractically of using more gloves to remedy the problem of common surfaces and the resulting cross-contamination in the traditional treatment room setting. As stated above multiple glove changes are simply unfeasible and impractical in terms of time and increased consumption of gloves. In reality the traditional treatment environment depicted in FIG. 1 is microbiologically obsolete in terms of aseptic treatment objectives and in fact a threat to the health of dental patients. Early in a treatment procedure gloves 12 and 15 become carriers of saliva and blood and carry such contaminating body fluids to every surface they contact.

FIG. 1 also highlights the impracticality and in certain instances impossibility of any consideration of moving most equipment, instruments, and supplies to a second treatment room for use on another patient. Nearly every item of equipment, instruments, and supplies found in the traditional dental treatment room must be duplicated in each additional treatment room.

Figure 2:
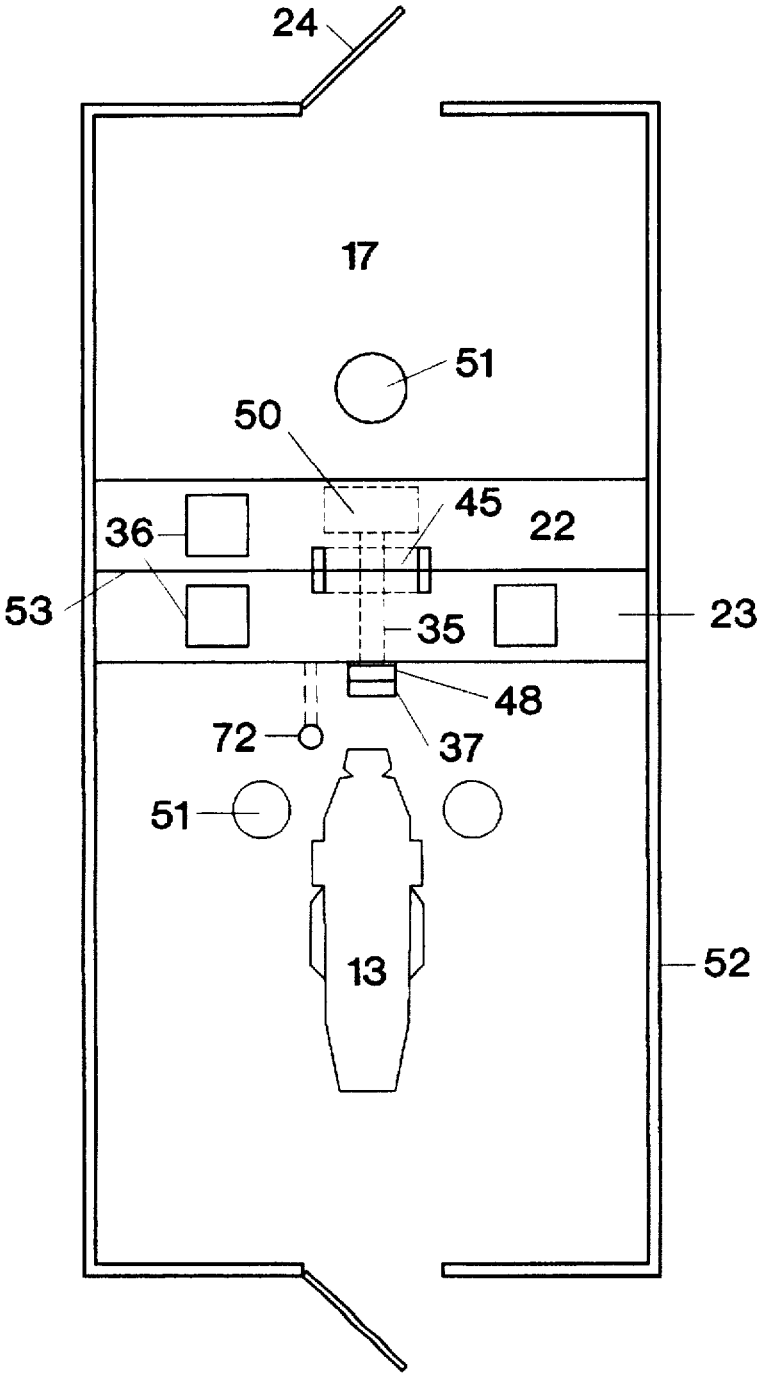
FIG. 2 is a plan view of the present invention wherein an isolated treatment module and an isolated supply module are depicted. The two modules are separated by glass partition 53 and access one another only by means of aperture 45 for the passage of instruments and supplies from the supply module to the treatment module. Dental control head mechanism 50 and a dental dispensing assistant are isolated with the supply space and are removed from the contaminants generated during treatment procedures in the treatment module. Attachable quick disconnect block 37 engages quick disconnect block support 48 establishing connections with the isolated dental control head mechanism 50 by means of connecting plumbing 35.

FIG. 2 is an overhead view of the present invention illustrating a dental treatment unit composed of an isolated supply module which mechanically engages an isolated treatment module wherein the two modules are separated by glass partition 53. A dentist and dental assistant function in the traditional manner around dental chair 13 and access isolated dental instruments and supplies through aperture 45 from a dental dispensing assistant isolated and functioning within supply space 17. Counter top 23 is equipped with quick disconnect block support 48 which receives block 37 containing attachments for high and slow speed handpieces (drills), a water-air syringe, and the associated tubing. It is important to note that block 37 is removed following a treatment procedure and that the handpieces, water-air syringe, and tubing are either autoclaved or placed sterilization prior to use on the next patient. Note that quick disconnect block support 48 is attached to dental control head mechanism 50 by plumbing connections 35. As can be seen, the control head mechanism 50 and the associated controls are located within the supply module and are physically isolated from contaminants generated during treatment procedures within the treatment module. Every item necessary for carrying out dental treatment with the exception of the high and slow speed handpieces (drills), water-air syringe, and the associated tubing is contained within the supply module and is handled only by the isolated and uncontaminated dental dispensing assistant. The treatment module is adequately ventilated to create a negative pressure to remove airborne contaminants generated during treatment procedures and the supply module receives uncontaminated air in an amount sufficient to establish a positive pressure and resulting air flow in the direction of the treatment module thus preventing the backflow of airborne contaminants from the treatment module. Both the treatment module and the supply module are effectively sealed when the access doors are closed.

Figure 3:
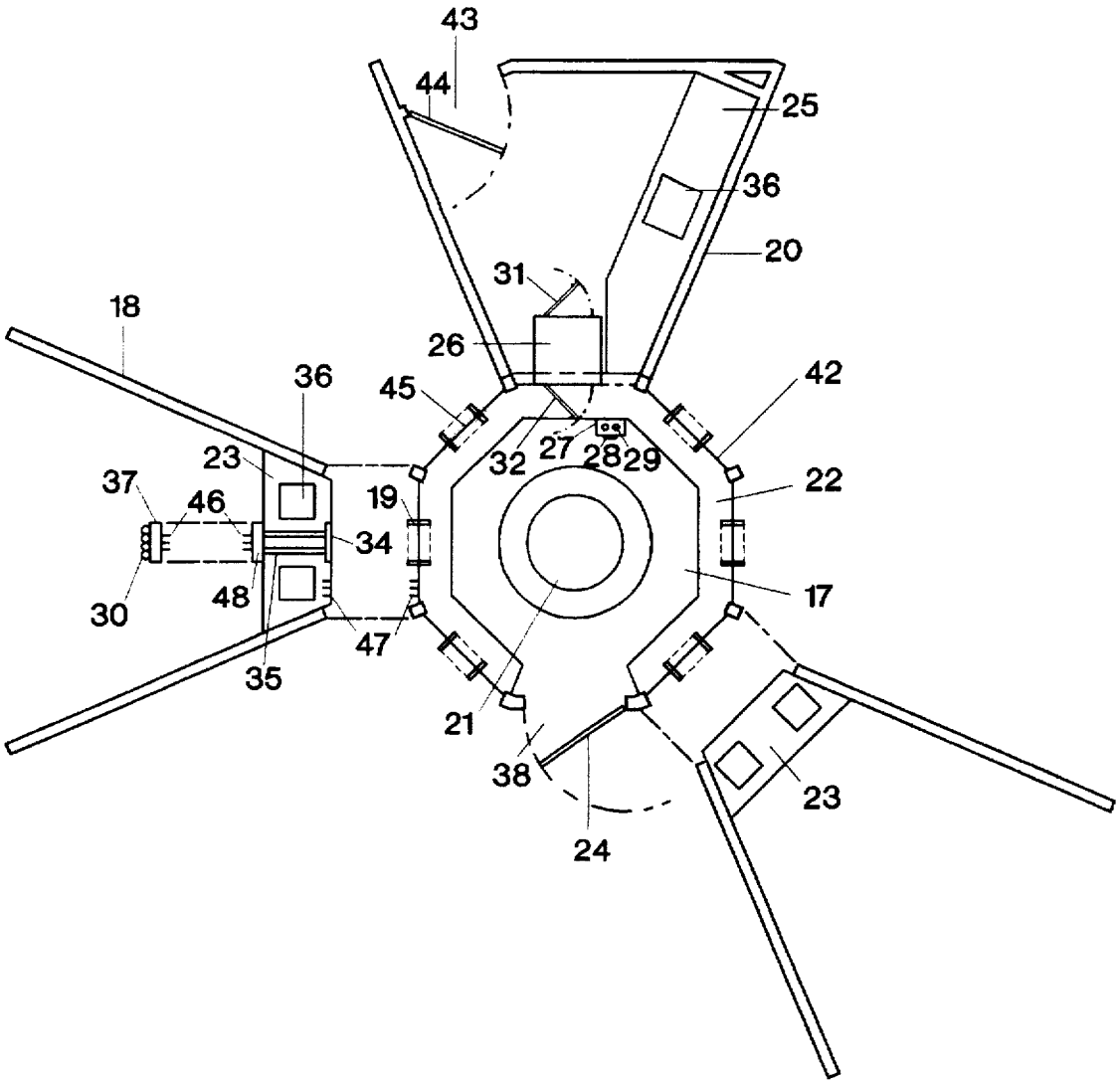
FIG. 3 is a schematic view of the present invention wherein a central supply core is depicted surrounded by two treatment modules in pre-engage positions and a sterilization module in the engaged position. Connectors are shown which enable treatment modules to couple and engage the central core systems for treatment functions.

FIG. 3 illustrates another embodiment of the present invention involving a plurality of treatment modules surrounding a single central supply core element. FIG. 3 is an overhead view of the present invention illustrating an isolated aseptic central core component 42 surrounded by attachable treatment modules 18 in pre-engaged positions with a sterilization module 20 in the engaged position. Sterilization module 20 is accessed by means of passageway 43 and isolated by door 44. Instruments are brought into sterilization module 20 through passageway 43 and washed, disinfected, bagged or placed in other suitable containers, and inserted into pass-through autoclave 26. Autoclave door 31 is closed and after a sterilization cycle the instruments are removed by opening autoclave door 32 within isolated central core 42 thus taking full advantage of the intended pass-through autoclave concept. Within central core 42 the instruments are sorted and placed into a rotatable multilevel central supply unit 21 so that they may be rotated into alignment with any treatment module access opening. The dental dispensing assistant working within space 17 may move to any access opening, align the desired instruments, equipment, and supplies housed within central supply unit 21 and dispense such items to the dentist and dental assistant working within a treatment module. Treatment module 18 is depicted in a pre-engage position with connectors 19 shown aligned with receptors 34. Receptors 34 are connected to plumbing 35 which terminates at quick disconnects 46 for the attachment of dental instruments 30. It should be noted that dental instruments (handpieces or drills and water/air syringe) connected to and supported by block 37 are a fixed part of the traditional dental operatory being contaminated with spatter and aerosol with each utilization. Therefore, tubing on the traditional dental unit becomes a means for cross-contamination. The dental instruments supported by block 37 and associated with the concept of the present invention are removed from the treatment module following each utilization and all tubing and fittings are washed in detergents and cold sterilized in a similar manner as is practiced within the medical profession, i.e. gastroenterology examination equipment sterilization procedures. Sinks 36 within the sterilization module and treatment modules are all equipped with light or sound activated faucets and countertops 23 within treatment modules are covered with disposable plastic for a single patient treatment utilization. Drawer 27 is of interest in that it is isolated from contaminants as are drawer handle 28 and containers 29. Keep in mind that drawer handle 28 and containers 29 will never be handled with gloves that come into contact with saliva, blood, or other contaminating debris within the treatment room as is currently the case in the traditional dental operatory.

Figure 4:
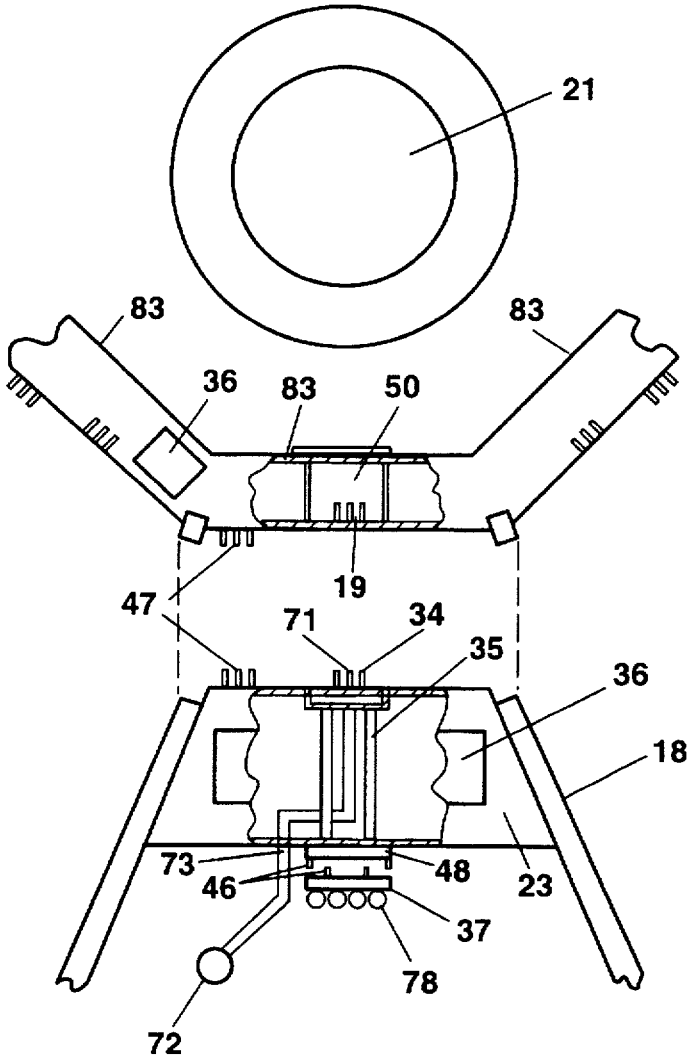
FIG. 4 is a schematic view of the present invention wherein a segment of the central supply core is shown in an enlarged overhead view with plumbing and electrical components depicted.

FIG. 4 is an enlarged overhead view of work positions 83 within the central core and one treatment module in a pre-engage position with plumbing and electrical components and connectors depicted. A primary unique aspect of the present invention is that dental control head mechanism 50 (handpiece and water-air syringe mechanism) is housed within the core environment entirely removed from the contaminants associated with treatment procedures in the treatment modules. As can be observed dental control head mechanism 50 is equipped with female connectors 19 which engage connectors 34 when treatment module 18 in coupled and interlocked with the core. Connectors 34 are a part of plumbing element 35 and quick disconnect block 48. Quick disconnect block 48 accommodates an attaching quick disconnect block 37 which connects to hoses and to the associated handpieces (drills) and water/air syringe. It should be noted that connector 71 engages dental control head mechanism 50 to provide function to dental unit foot control 72 when attached to connector 73. Note that dental control head mechanism 50 is a conventional dental mechanism in an unconventional and isolated location. The traditional quick disconnect mechanism depicted in FIG. 4 is used to enable the removal of quick disconnect block 37 and the associated tubing for cold sterilization procedures between patients. This practice in a dental setting would be virtually the same as with many areas within the medical profession.

Figure 5:
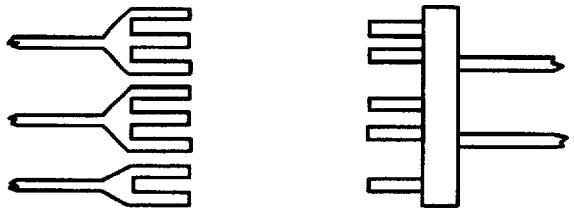
FIG. 5 depicts a cross-sectional view of a typical male and female quick disconnect coupling.
Figure 6:
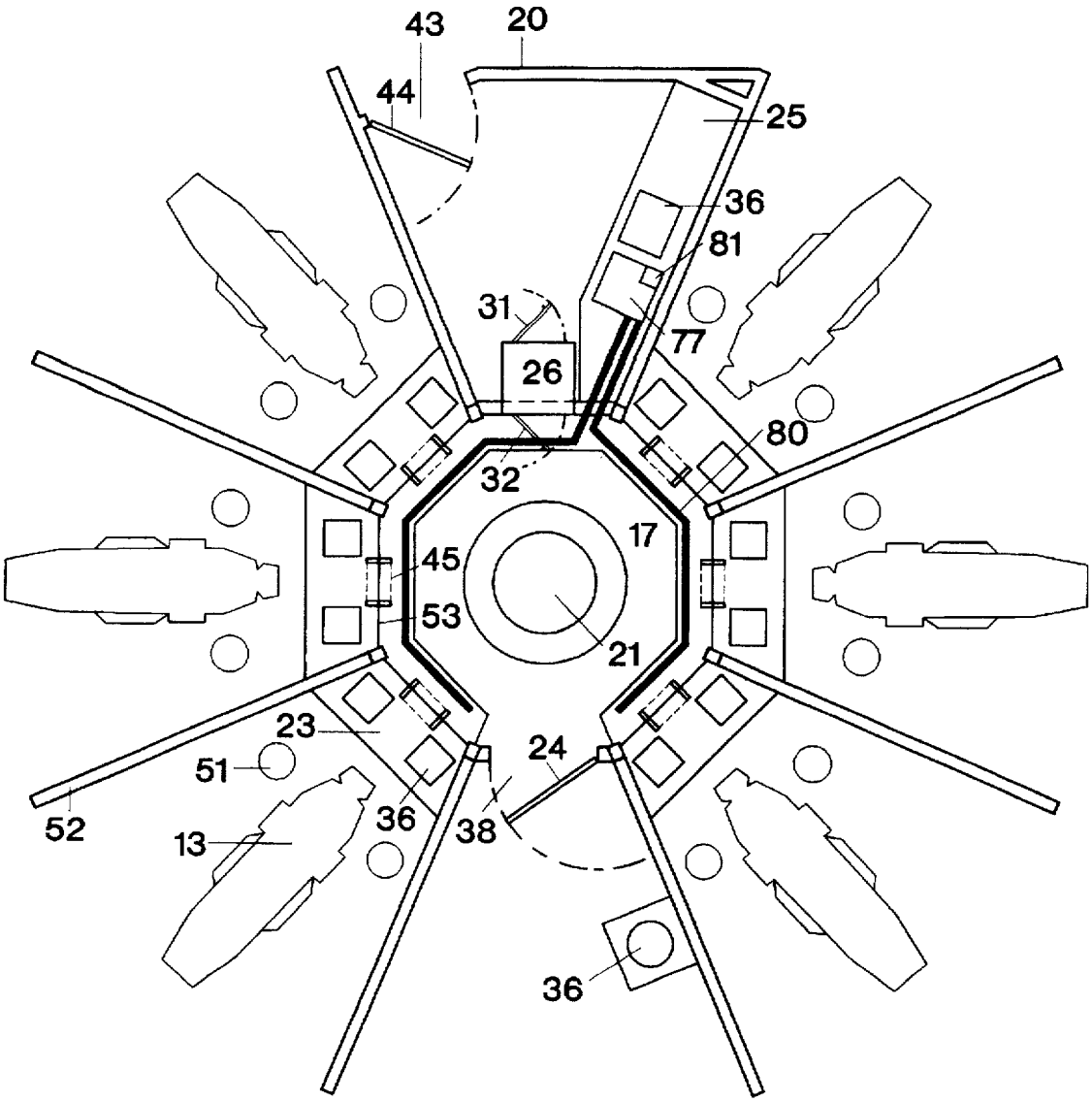
FIG. 6 is an overhead view of the core with all modules engaged and with plumbing and electrical lines extended and coupled with each treatment module.

FIG. 6 is an overhead view of the core with all treatment modules engaged and with the plumbing and electrical conduits within the core unit highlighted to illustrate the advantage of the above-the-floor plumbing concept. Conventional central dental systems (air compressor, deaquavator, and vacuum pump) are housed below counter 25 in an enclosed ventilated space 77. Space 77 also contains municipal service connection points 81 for connection to electrical conduits and water pipes 80 supplying each module site around the periphery of the core. The advantage here goes beyond economic considerations to enable virtually any open office space to be utilized for a dental office or clinic. From an economic consideration the amount of plumbing and the associated labor costs of conventional dental installations is dramatically reduced. Note that the present invention calls for dental chair 13, dental stool 51, and countertop 23 to be covered with disposable plastic and disposed of after each patient. Given the fact that all supply containers and instruments are located out of the treatment module and that the plastic drapes will be properly bundled and disposed of after each patient, the present invention provides a safe treatment environment for any form of dental treatment. In theory the present invention as depicted in FIG. 5 provides a safe treatment environment for a healthy individual to follow an HIV, TB, or HBV positive patient without fear of infection.

Figure 7:
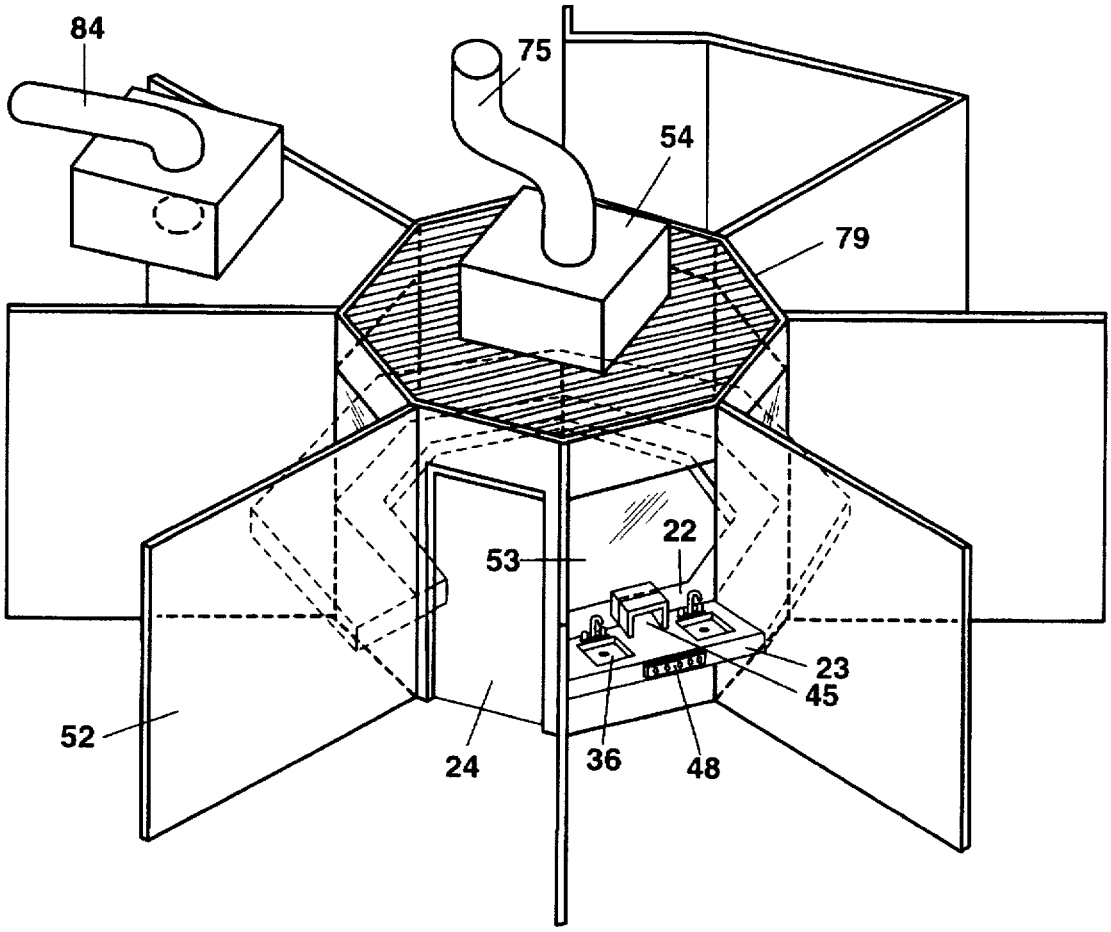
FIG. 7 is a perspective or isometric view of the core unit and the attached treatment modules. Again

In FIG. 7 a perspective or isometric view of the central supply core with all treatment modules engaged is shown. Air filtration unit 54 is situated above the ceiling of the core complex providing the core environment with clean filtered air from an uncontaminated source 75. Blowers within air filtration unit 54 provide the core with a positive air pressure thus creating a continual air flow through access openings 45 and in effect posing an air barrier to any contaminating debris and aerosols which could drift back from treatment modules. Treatment modules are equipped with air evacuation fans 76 which extract contaminated airborne debris and aerosols from the treatment module and exhaust them to the outside through ventilation duct 84. FIG. 7 clearly illustrates the advantages of the present invention in that the core is shown as an isolated environment from the contaminants of the treatment module with access opening 45 through glass window 53 being the only opening connecting the core with the module while air filtration unit 54 supplies a continuous flow of clean air to establish an outward flow of air through access opening 45. One can easily visualize the advantage of the dispensing assistant being able to see and monitor the condition of the patients seated in the treatment module through window 53, the aseptic ideal of all instruments, supplies, and materials being isolated from the treatment module, the aseptic ideal of the utilization of quick disconnect block 48 providing a means for removing the tubing and associated dental instruments for cold sterilization between patients, and the efficiency advantage provided by the concept in that a plurality of treatment modules are accessible with minimal reach from the core component.

It should be noted that the present invention incorporates the necessary microphones and speakers to enable the dental team to carry on conversation between the core and treatment module without inconvenience. The same equipment would enable the dispensing assistant not only to visually monitor the unattended patient but also verbally communicate with the patient to determine his condition.

Figure 8:
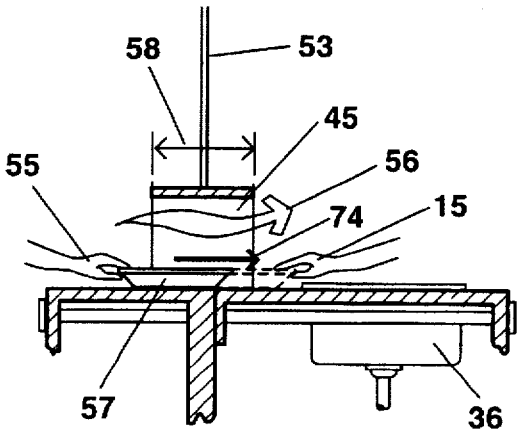
FIG. 8 is a cross-sectional view of the wall separating the treatment environment within the module and the material storage and dispensing environment within the central core as well as the countertops on each side of the wall. The hand of the dispensing assistant within the core is depicted sliding a disposable transport tray through an opening in the wall to a position beyond a designated point and into the reach of the hand of the dental assistant within a treatment module. Two arrows represent the direction of motion, the direction of air flow from within the positive pressure core environment into the normal pressure environment of the treatment module, and demonstrate that everything always travels in the direction of the treatment module with absolutely nothing ever passed in the opposite direction.

FIG. 8 shows a cross-sectional view of the wall separating the treatment module and the core space as well as the countertops on each side of the wall. Transport tray 57 is a disposable item made of paper or styrofoam and intended for a one time use as a materials transport means from the core into the module. It is important to realize that the present invention calls for inviolate zone or space 58 to be clearly identified by markings on the surface of the countertops and for dental team members to be trained to recognize this zone as being critical to the aseptic objectives of the present invention. Proper pass off procedures and techniques involving inviolate zone 58 are essential. Aseptic inviolate zone 58 is recognized as an extension of the uncontaminated core space and is never touched by anything from within the treatment module. The dispensing assistant's hand 55 is shown moving disposable transport tray 57 into aseptic inviolate zone 58 and through access opening 45 to the dental assistant's hand 15. While the dental assistant's hand 15 can not enter zone 58 it should also be noted that the dispensing assistant's hand 55 can not enter the forward one half of zone 58. Thus inviolate zone 58 is established as an untouched and uncontaminated space with techniques practiced and enforced to achieve this objective. Arrow 56 depicts the direction of movement of positive pressure air to prevent drift of contaminants from the treatment module back into the core while arrow 74 depicts the direction on movement items passed from the core to the module. Absolutely nothing is ever passed from the module into the core. Every item used in the module comes from the core and is either disposable or removed from the core following a treatment procedure and taken directly to central sterilization and processed through pass-through autoclave 26 back into the core. Obviously, any number of techniques could be developed to achieve the aseptic objectives involving hand off procedures associated with the present invention.

Figure 9:
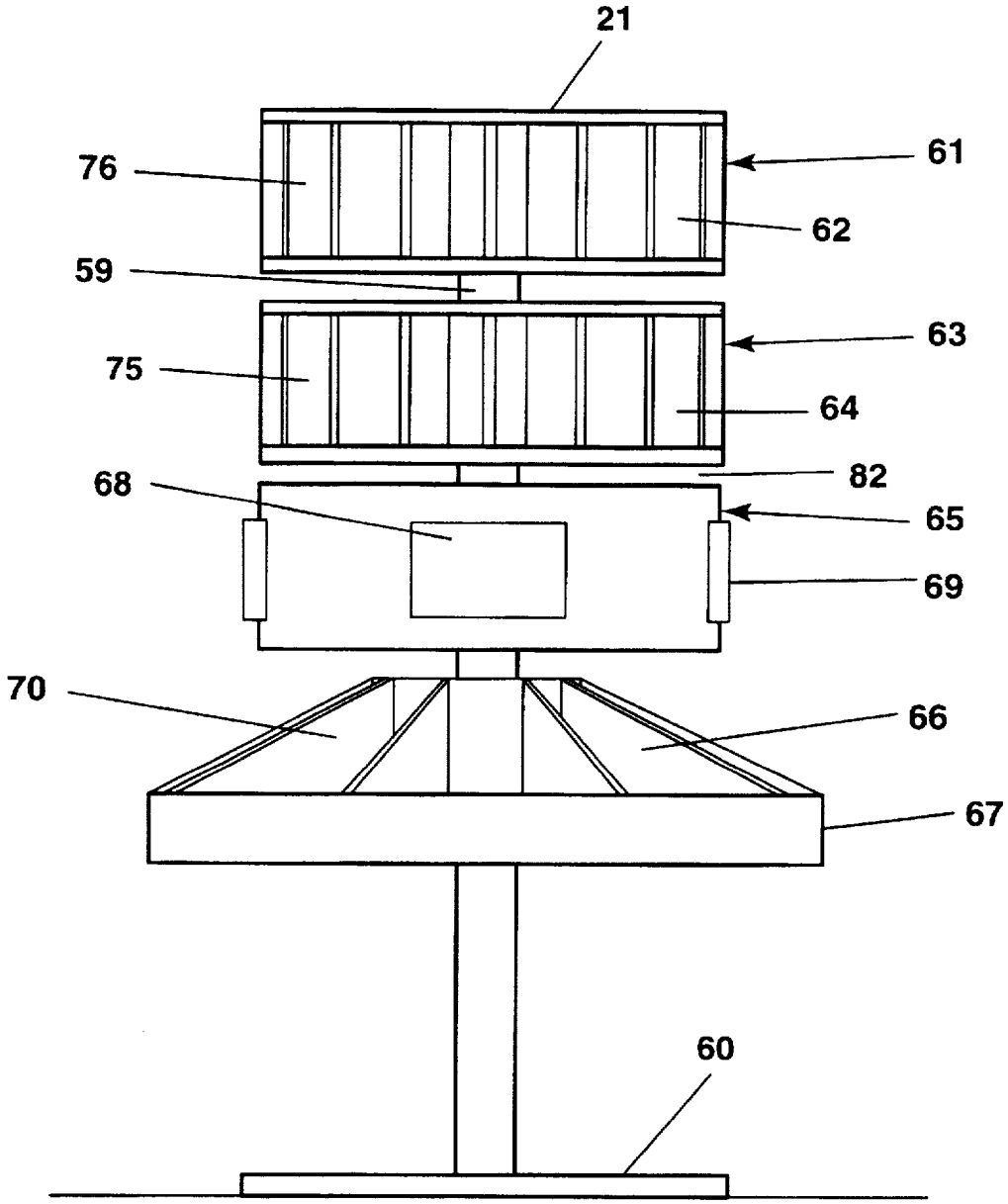
FIG. 9 is a schematic view of the multilevel rotatable central supply unit located within and at the center of the core work space.

FIG. 9 depicts a multilevel rotatable central supply unit 21 which is located within and at the center of the core work space 17. Unit 21 is designed to provide independent rotation of each level of supply, material, and instrument slots so that any combination of slots may be aligned opposite any treatment module access window. Rotating components 61 and 63 may be positioned to align slot 62 and 64 above amalgamator 68 which is attached to rotating instrument housing 65. Rotating component 67 may also be positioned to bring slot 66 below and in alignment with amalgamator 68. In the arrangement described above all instruments, supplies, and materials pertaining to the placement of amalgam fillings are housed within slots 62, 64, and 66 and are brought into alignment with amalgamator 68 for convenient and rapid access thereto by the dispensing assistant. Obviously, slots 75, 76, and 70 can be aligned with instrument position 69 to bring into alignment all instruments, supplies, and materials pertaining to another treatment procedure such as crown and bridge.

One of the most notable advantages of the present invention is that amalgamator 68 can be positioned opposite any module access window for the dispensing of amalgam filling material. This single illustration could be applied to several relatively expensive dental instruments which at present must be duplicated in each treatment room in the conventional setting. The central supply core in combination with rotatable central supply unit 21 eliminates the need to purchase large numbers of identical dental instruments and devices as the present invention enables one unit to serve multiple treatment rooms.

In conclusion, the benefits provided by the present invention can be appreciated if contrasted with the traditional or characteristic activity associated with the delivery of dental treatment. The individual components when combined provide the dental profession with a means of delivering aseptic dental treatment procedures heretofore nonexistant. In combination the components yield a distinct and unique advantage in terms of minimizing the risk of cross-contaminating dental patients with lethal pathogens. The combined components provide an aseptic margin of safety which cannot be found in the traditional dental setting and which is essential to the health and well being of dental patients.

In the face of well established prior art it is significant to note that no dental equipment design to date has provided the results of the combined components of the present invention. A long felt but unfulfilled need for a means of providing aseptic dental treatment has existed since the inception of dentistry but clearly has not been satisfied prior the the present invention. The unique aseptic treatment advantage provided must be considered in light of the fact that the dental manufacturing industry is well established with a history that spans over a century. Prior art is plentiful yet divulges nothing which provides a definitive solution to ending the cross contamination of dental patients. It is of absolute significance that millions of research dollars have been spent by manufacturers with meaningless results when the problem is evaluated scientifically. The need for a means of providing aseptic dental treatment has also been addressed on the university level with additional millions of research dollars having been invested and yet the need goes unmet and tolerated while the public remains uninformed.

What is claimed, in combination, is:

1. A dental treatment unit comprising:

a. a treatment module;

b. a supply module adjacent the treatment module, the supply module including means to store dental treatment instruments and supplies for use in the treatment module;

c. a partition which separates and isolates the treatment module from the supply module;

d. an access opening in the partition to allow for passage of the dental instruments and supplies into the treatment module from the supply module;

e. pneumatic means to inhibit movement of airborne contaminants through the access opening from the treatment module to the supply module; and f. whereby a dental patient can be treated inside the treatment module using dental instruments and supplies that have been passed through the access opening in the partition from the supply module without contamination of instruments and supplies in the supply module by airborne contaminants from the treatment module, and whereby the treatment module can be de-contaminated without contamination of instruments in the supply module.

* * * * *